US009028025B2

(12) United States Patent
Norigoe

(10) Patent No.: US 9,028,025 B2
(45) Date of Patent: May 12, 2015

(54) INK JET HEAD AND INK JET PRINTING APPARATUS WITH DRIVING CHANNELS AND DUMMY CHANNELS

(71) Applicants: Kabushiki Kaisha Toshiba, Tokyo (JP); Toshiba Tec Kabushiki Kaisha, Tokyo (JP)

(72) Inventor: Takashi Norigoe, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/192,576

(22) Filed: Feb. 27, 2014

(65) Prior Publication Data

US 2014/0253619 A1 Sep. 11, 2014

(30) Foreign Application Priority Data

Mar. 6, 2013 (JP) ..... 2013-044463

(51) Int. Cl.
*B41J 29/38* (2006.01)
*B41J 2/045* (2006.01)
*B41J 2/14* (2006.01)

(52) U.S. Cl.
CPC ..... *B41J 2/04541* (2013.01); *B41J 2/045* (2013.01); *B41J 2/14209* (2013.01); *B41J 2002/14491* (2013.01); *B41J 2202/11* (2013.01)

(58) Field of Classification Search
CPC ..... B41J 2/045; B41J 2/1643; B41J 2/1642; B41J 2/04508; B41J 2/04551; B41J 2/04581; B41J 2202/10
USPC ..... 347/11, 48, 60, 68, 70, 71
See application file for complete search history.

(56) References Cited

U.S. PATENT DOCUMENTS

| | | | | |
|---|---|---|---|---|
| 6,193,343 | B1 | 2/2001 | Norigoe et al. | |
| 6,416,149 | B2 * | 7/2002 | Takahashi | 347/10 |
| 2010/0141711 | A1 | 6/2010 | Koseki | |

FOREIGN PATENT DOCUMENTS

| | | |
|---|---|---|
| JP | 2002-120367 | 4/2002 |
| JP | 2011-037193 | 2/2011 |

OTHER PUBLICATIONS

Office Action mailed Oct. 14, 2014, filed in corresponding Japanese Patent Application No. 2013-044463, with English translation.

* cited by examiner

*Primary Examiner* — Juanita D Jackson
(74) *Attorney, Agent, or Firm* — Patterson & Sheridan LLP

(57) ABSTRACT

An ink jet head includes a plurality of nozzles and a piezoelectric member provided with driving channels for storing ink. Each of the driving channels communicates a respective one of the nozzles. Dummy channels are alternately arranged with the driving channels. First side walls between the driving and dummy channels include a first driving channel side surface and a first dummy side surface. Second side walls between the driving channels and the dummy channels include a second driving channel side surface and a second dummy channel side surface. When a voltage is applied to electrodes on the first dummy channel side surfaces, the corresponding first side wall is deformed. When a voltage is applied to electrodes on the second dummy channel side surfaces, the second side wall is deformed.

18 Claims, 7 Drawing Sheets

INK JET HEAD AND INK JET PRINTING APPARATUS WITH DRIVING CHANNELS AND DUMMY CHANNELS

CROSS-REFERENCE TO RELATED APPLICATION

This application is based upon and claims the benefit of priority from Japanese Patent Application No. 2013-044463, filed Mar. 6, 2013, the entire contents of which are incorporated herein by reference.

FIELD

Embodiments described herein relate generally to an inkjet head and an ink jet recording apparatus.

BACKGROUND

An ink jet recording apparatus such as an ink jet printer includes an ink jet head for ejecting ink. For example, a shear-mode type ink jet head has a piezoelectric member for pressurizing ink and ejecting the pressurized ink.

The piezoelectric member contains a pressure chamber for storing ink, and an electrode covering the inside surface of the pressure chamber, for example. When a voltage is applied to the electrode, a potential difference produced thereby causes shear-mode deformation of the piezoelectric member, and pressurizes the ink stored in the pressure chamber. The pressure chamber communicates with an opening of a nozzle, and allows ejection of the pressurized ink through the nozzle.

An ink jet head of a type having an electrode included in the pressure chamber that is subjected to direct contact with ink is known in the art. When this type of ink jet head uses water-based ink, electrolysis may develop in some cases due to a voltage supplied to the electrode. Under the condition of electrolysis, there is a possibility of formation of bubbles in the ink, or dissolution of the electrode in the ink. The use of an electrode coated with insulation film for avoiding development of electrolysis increases the manufacturing cost of the ink jet head.

DETAILED DESCRIPTION

In general, according to one embodiment, it is an object achieved by the embodiment to provide an ink jet head and an ink jet recording apparatus capable of using water-based ink.

An ink jet head according to an embodiment includes a plurality of nozzles and a piezoelectric member provided with driving channels for storing ink. Each of the driving channels communicates a respective one of the nozzles. Dummy channels are alternately arranged with the driving channels. First side walls between the driving and dummy channels include a first driving channel side surface and a first dummy side surface. Second side walls between the driving channels and the dummy channels include a second driving channel side surface and a second dummy channel side surface. A plurality of first electrodes are provided on the first and second driving channel side surfaces. A plurality of second electrodes are provided on the first dummy channel side surfaces. A plurality of third electrodes are provided on the second dummy channel side surfaces separate from the second electrodes. When a voltage is applied to one of the second electrodes, the corresponding first side wall is deformed such that a capacity of the corresponding driving channel changes. When a voltage is applied to one of the third electrodes, the corresponding second side wall is deformed such that the capacity of the corresponding driving channel changes.

An exemplary embodiment is hereinafter described with reference to FIGS. 1 through 8. In the following description, some parts are given one or plural expression examples when the parts are allowed to be expressed in plural ways. However, it is not intended that providing other expressions for parts not given plural expressions should be limiting, nor intended that providing expressions other than the expression examples shown in this embodiment for any parts should be limiting. In addition, the respective figures are only schematic illustrations of the embodiment, and the sizes of some parts depicted in the figures may be different from the sizes of the corresponding parts in conformity with the teachings of the embodiment.

Figure 1:
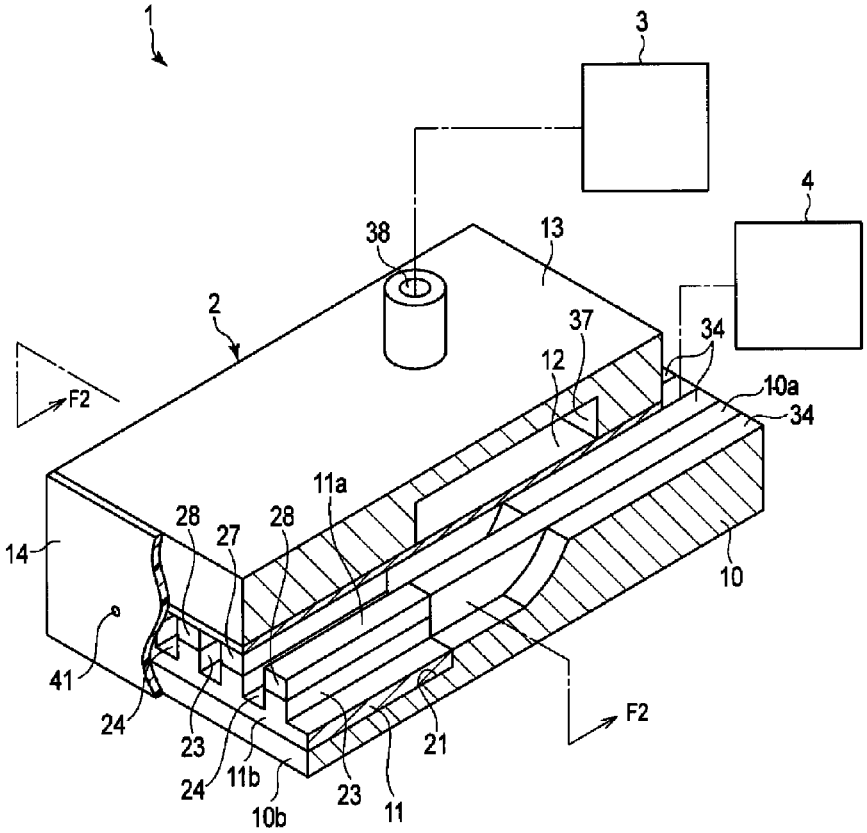
FIG. 1 is a perspective view illustrating an ink jet recording apparatus according to an embodiment.

FIG. 1 is a perspective view illustrating a part of an ink jet recording apparatus 1 according to an embodiment. The ink jet recording apparatus 1 is an ink jet printer, for example. The ink jet recording apparatus 1 is not limited to an ink jet printer but may be various apparatuses such as a copying machine or multi-function peripheral (MFP).

As illustrated in FIG. 1, the ink jet recording apparatus 1 includes an ink jet head 2, an ink tank 3, and a control unit 4. The ink jet recording apparatus 1 may further include, for example, a housing, a feeder for supplying sheets, a sheet tray for accommodating the sheets, and other components.

The ink jet head 2 is a so-called end-shooter type and shear-mode type inkjet head. However, the inkjet head 2 is not limited to this type. The ink jet head 2 is located within the housing, and prints characters and figures, for example, on a medium such as a recording sheet supplied by the feeder.

The ink jet head 2 includes a base 10, a piezoelectric member 11, a top plate 12, a top board 13, and a nozzle plate 14. The ink jet head 2 further includes, for example, a cover, a tube connected with the ink tank 3, a carriage for shifting the ink jet head 2 within the ink jet recording apparatus 1, and other components.

The base 10 is a rectangular plate. An attachment portion 21 is formed at an end of the base 10. The attachment portion 21 is a notch open to an upper surface 10*a* and a front surface 10*b* of the base 10. The upper surface 10*a* and the front surface 10*b* are flat surfaces intersecting each other orthogonally.

The piezoelectric member 11 is a rectangular plate material smaller than the base 10. The piezoelectric member 11 is constituted by two plate-shaped piezoelectric bodies joined to each other, for example. Each of the piezoelectric bodies may be made of lead zirconate titanate (PZT), for example. The polarization directions of the two piezoelectric bodies are opposite to each other in the thickness direction thereof.

The base 10 and the piezoelectric member 11 contain a plurality of driving channels (pressure chambers) 23, and a plurality of dummy channels 24. The driving channels 23 and the dummy channels 24 are grooves extending from the base 10 to the piezoelectric member 11. The driving channels 23 and the dummy channels 24 may have the same shape. The cross-sectional shape thereof may be rectangular, for example. Alternatively, the shapes of the driving channels 23 may be different from the shapes of the dummy channels 24. The driving channels 23 and the dummy channels 24 may be produced by a dicer, for example.

The driving channels 23 and the dummy channels 24 are open to the upper surface 10*a* of the base 10 and an upper surface 11*a* of the piezoelectric member 11, and to a front surface 11*b* of the piezoelectric member 11. The upper surface 10*a* of the base forms a plane flush with the upper surface 11*a* of the piezoelectric member 11. Similarly, the front surface 10*b* of the base 10 forms a plane flush with the front surface 11*b* of the piezoelectric member 11.

The driving channels 23 and the dummy channels 24 are alternately positioned along the front surface 11*b* of the piezoelectric member 11. The piezoelectric member 11 includes a plurality of first side walls 27 and a plurality of second side walls 28 formed by the plural driving channels 23 and the plural dummy channels 24.

Figure 2:
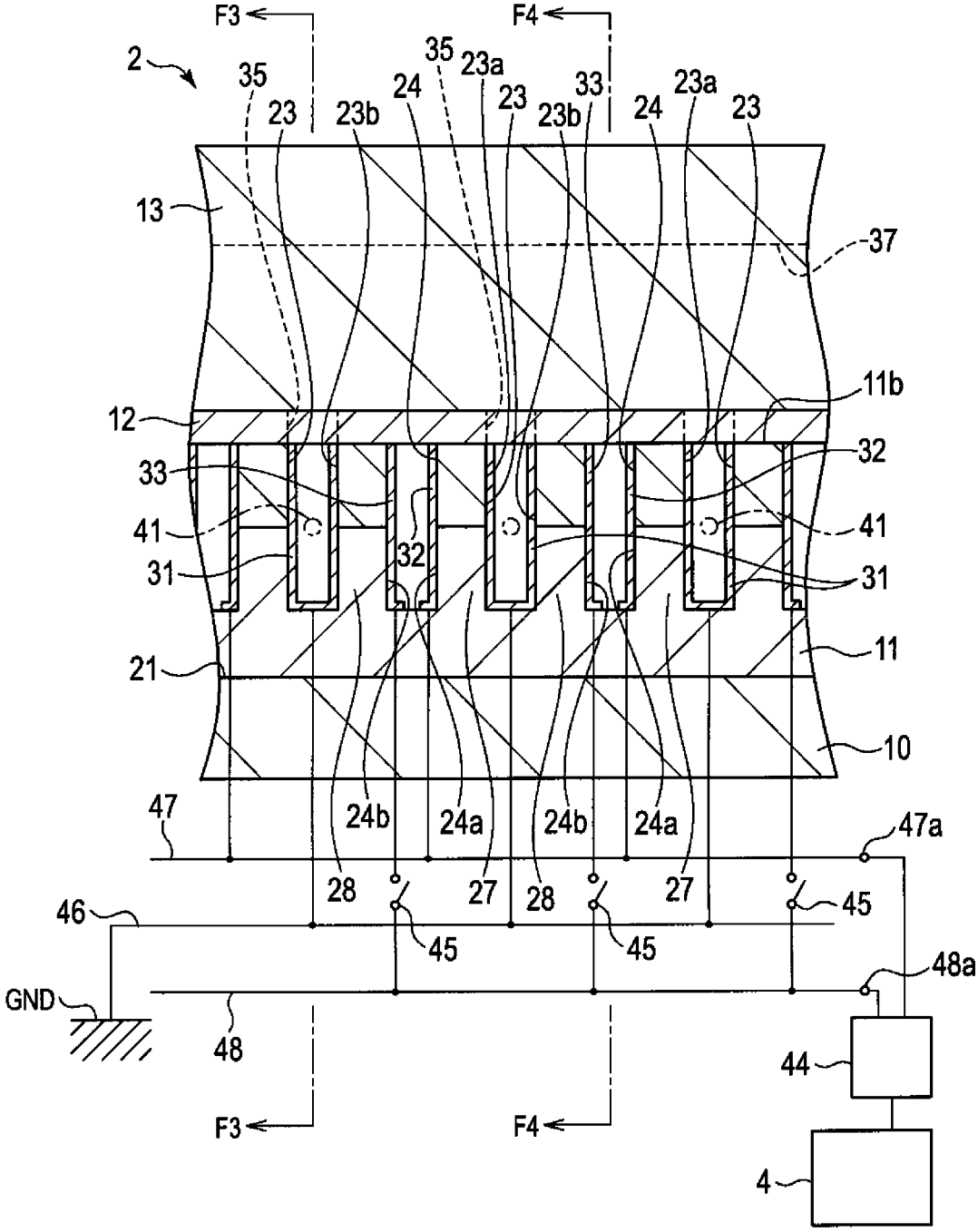
FIG. 2 is a cross-sectional view illustrating the ink jet head taken along a line F2-F2 in FIG. 1.

FIG. 2 is a cross-sectional view illustrating a part of the ink jet head 2 taken along a line F2-F2 in FIG. 1. As shown in FIG. 2, the first side walls 27 are positioned between the driving channels 23 and the dummy channels 24. Each of the first side walls 27 constitutes a first side surface 23*a* of the corresponding driving channel 23 and a first side surface 24*a* of the corresponding dummy channel 24. Each of the first side surfaces 23*a* of the driving channels 23 is positioned on the corresponding first side wall 27 on the side opposite to the first side surface 24*a* of the corresponding dummy channel 24.

The second side walls 28 are positioned between the driving channels 23 and the dummy channels 24. The first side walls 27 and the second side walls 28 are alternately positioned along the front surface 11*b* of the piezoelectric member 11. Accordingly, the respective first side walls 27 are opposed to the adjoining second side walls 28.

Each of the second side walls 28 constitutes a second side surface 23*b* of the corresponding driving channel 23 and a second side surface 24*b* of the corresponding dummy channel 24. Each of the second side surfaces 23*b* of the driving channels 23 faces to the first side surface 23*a* of the corresponding driving channel 23. In addition, each of the second side surfaces 23*b* of the driving channels 23 is positioned on the corresponding second side wall 28 on the side opposite to the second side surface 24*b* of the corresponding dummy channel 24. Each of the second side surfaces 24*b* of the dummy channels 24 faces to the first side surface 24*a* of the corresponding dummy channel 24.

A plurality of first electrodes 31 cover the inside surfaces of the plural driving channels 23. In other words, the first electrodes 31 are formed on the first and second side surfaces 23*a* and 23*b* of the respective driving channels 23. The first electrode 31 formed on the first side surface 23*a* of each of the driving channels 23 passes through the bottom of the corresponding driving channel 23 and is connected to the first electrode 31 formed on the second side surface 23*b* of the corresponding driving channel 23. Each of the first electrodes 31 may be made of nickel plating, for example.

A plurality of second electrodes 32 are formed on the first side surfaces 24*a* of the plural dummy channels 24. Further, a plurality of third electrodes 33 are formed on the second side surfaces 24*b* of the plural dummy channels 24. The third electrodes 33 are separated from the second electrodes 32. In other words, the second electrodes 32 and the third electrodes 33 are electrically separated from each other. Each of the second and third electrodes 32 and 33 may be made of nickel plating, for example. The second and third electrodes 32 and 33 constructed as above are formed by separating bottoms of the nickel plating covering the inside surfaces of the dummy channels 24 into discrete parts using laser beams, for example.

As illustrated in FIG. 1, a plurality of wires 34 are provided on the upper surface 10*a* of the base 10. The plural wires (made of nickel plating, for example) electrically connect with the corresponding first through third electrodes 31, 32, and 33. The plural wires 34 extend from the first electrodes 31, the second electrodes 32, and the third electrodes 33, toward the rear end of the base 10.

Figure 3:
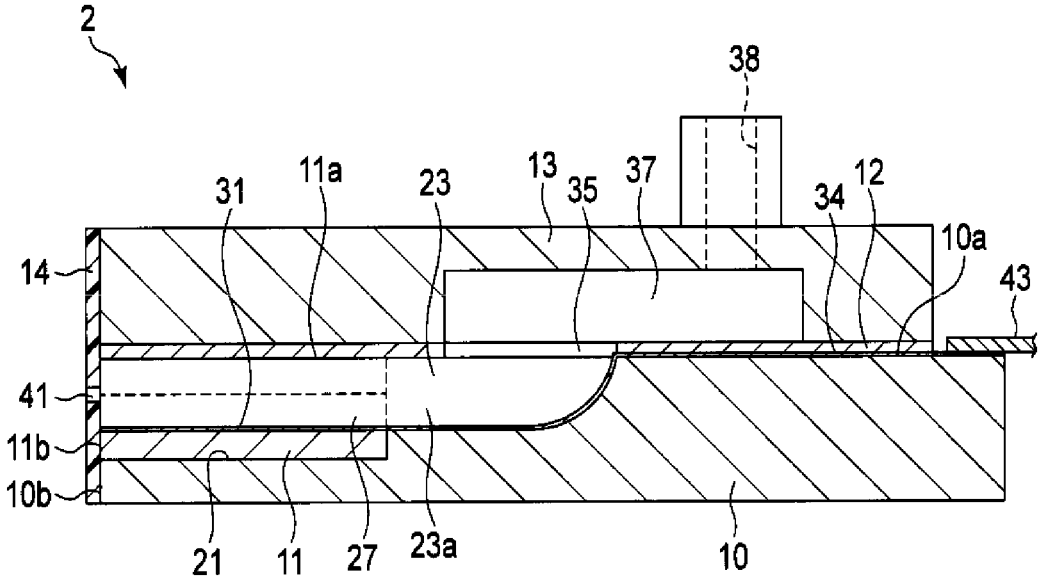
FIG. 3 is a cross-sectional view illustrating the ink jet head taken along a line F3-F3 in FIG. 2.
Figure 4:
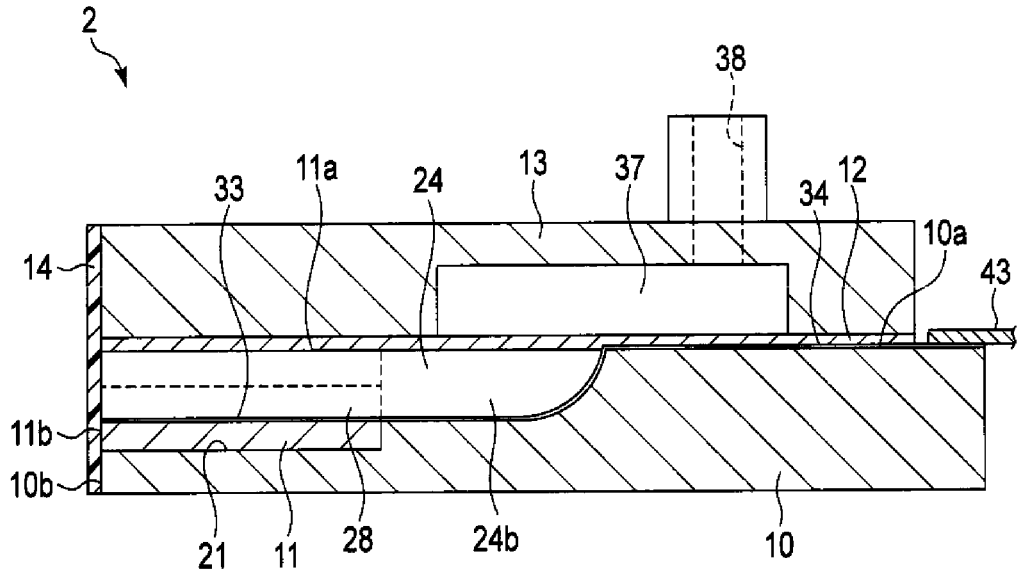
FIG. 4 is a cross-sectional view illustrating the ink jet head taken along a line F4-F4 in FIG. 2.

FIG. 3 is a cross-sectional view illustrating the ink jet head 2 taken along a line F3-F3 in FIG. 2. FIG. 4 is a cross-sectional view illustrating the inkjet head 2 taken along a line F4-F4 in FIG. 2. As shown in FIGS. 3 and 4, the top plate 12 is attached to the upper surfaces 10*a* and 11*a* of the base 10 and the piezoelectric member 11. The top plate 12 is provided with a plurality of openings 35. The openings 35 are positioned in correspondence with the positions of the plural driving channels 23. The top plate 12 opens the driving channels 23 at the openings 35, and closes the dummy channels 24.

The top board 13 is attached to the top plate 12. According to this structure, the top plate 12 is positioned between the top board 13 and the two components of the base 10 and the piezoelectric member 11. The top board 13 contains a common liquid chamber 37. The common liquid chamber 37 is a groove open toward the top plate 12.

The common liquid chamber 37 communicates with the plural driving channels 23 via the plural openings 35. The top plate 12 separates the plural dummy channels 24 from the common liquid chamber 37.

The top board 13 further includes a connection port 38. As indicated by broken lines in FIG. 3, the connection port 38 opens to the common liquid chamber 37. The connection port 38 is connected to the ink tank 3 via the tube. According to this structure, ink stored in the ink tank 3 is supplied to the common liquid chamber 37 through the connection port 38.

The nozzle plate 14 is attached to the front surfaces 10*b* and 11*b* of the base 10 and the piezoelectric member 11. The nozzle plate 14 includes a plurality of nozzles 41. The nozzles 41 are holes through which ink drops are ejected. In FIG. 2, the nozzles 41 are shown by two-dot chain lines.

The plural nozzles 41 are positioned in correspondence with the positions of the driving channels 23. Each of the nozzles 41 is open to the corresponding driving channel 23. Accordingly, the driving channels 23 communicate with the outside of the ink jet head 2 through the nozzles 41. On the other hand, there are no nozzles corresponding to the dummy channels 24. In other words, the nozzles 41 are open to the driving channels 23 but not the dummy channels 24) formed in the piezoelectric member 11.

The ink supplied from the ink tank 3 to the common liquid chamber 37 passes through the plural openings 35 formed in the top plate 12, and flows into the plural driving channels 23. In other words, the driving channels 23 store the ink. The ink fills the driving channels 23. The ink forms a meniscus in each of the nozzles 41. The ink jet recording apparatus 1 controls the pressure of the ink within the driving channels 23 such that a meniscus stays in each of the nozzles 41.

The dummy channels 24 are closed by the top plate 12 and the nozzle plate 14. The dummy channels 24 are separated from the common liquid channel 37 by the top plate 12 do not receive supply of ink, and therefore hold air. In other words, the dummy channels 24 function as so-called air chambers. The dummy channels 24 may store other gases or liquids in place of the air, or may store ink.

As illustrated in FIG. 3, the ink jet head 2 further includes a driving circuit 43. The driving circuit 43 is connected to the plural wires 34. The driving circuit 43 includes, for example, a flexible printed circuit board (FPC), a printed circuit board (PCB), a signal generating unit 44 (shown in FIG. 2), a plurality of switches 45 (shown in FIG. 2), and various other components. The signal generating unit 44 may be a driving IC, for example. The driving circuit 43 is not limited to this type, and may be a TAB (tape automated bonding), for example. The switches 45 may be switching elements, for example.

The FPC is connected to the wires 34 by thermo-compression bonding using anisotropic conductive film (ACF), for example. By this, the driving circuit 43 is electrically connected with the first through third electrodes 31, 32, and 33 via the plural wires 34.

FIG. 2 is a cross-sectional view of the ink jet head 2, and further includes a schematic illustration of a circuit of the driving circuit 43. As shown in FIG. 2, the signal generating unit 44 of the driving circuit 43 is connected to the control unit 4 of the ink jet recording apparatus 1. The control unit 4 is a unit for controlling the ink jet recording apparatus 1, and includes a calculation device and a memory, for example. The control unit 4 allows the signal generating unit 44 to control the ink jet head 2 in accordance with the operation of a user, for example.

The driving circuit 43 includes a first common wire 46, a second common wire 47, and a third common wire 48. The first common wire 46 is connected to the plural first electrodes 31 via the plural wires 34. The second common wire 47 is connected to the plural second electrodes 32 via the plural wires 34. The third common wire 48 is connected to the plural third electrodes 33 via the plural wires 34.

The first common wire 46 is connected to a ground GND to be grounded. Accordingly, each of the plural first electrodes 31 is grounded via the first common wire 46. The potentials at the first electrodes 31 are kept at the ground potential. The potentials of the first electrodes 31 are not limited to the ground potential but may be maintained at other potentials.

The second common wire 47 includes a terminal 47*a*. The terminal 47*a* is connected to the signal generating unit 44. Accordingly, the plural second electrodes 32 connect with the signal generating unit 44 via the second common wire 47.

The third common wire 48 includes a terminal 48*a*. The terminal 48*a* is connected to the signal generating unit 44. Accordingly, the plural third electrodes 33 connect with the signal generating unit 44 via the third common wire 48.

The plural switches 45 are interposed between the plural third electrodes 33 and the third common wire 48. In the on condition, each of the switches 45 electrically connects the corresponding third electrode 33 with the third common wire 48. In the off condition, each of the switches 45 electrically disconnects the corresponding third electrode 33 from the third common wire 48. In other words, the switches 45 electrically connect the plural third electrodes 33 with the signal generating unit 44, or disconnect the plural third electrodes 33 from the signal generating unit 44.

Figure 5:
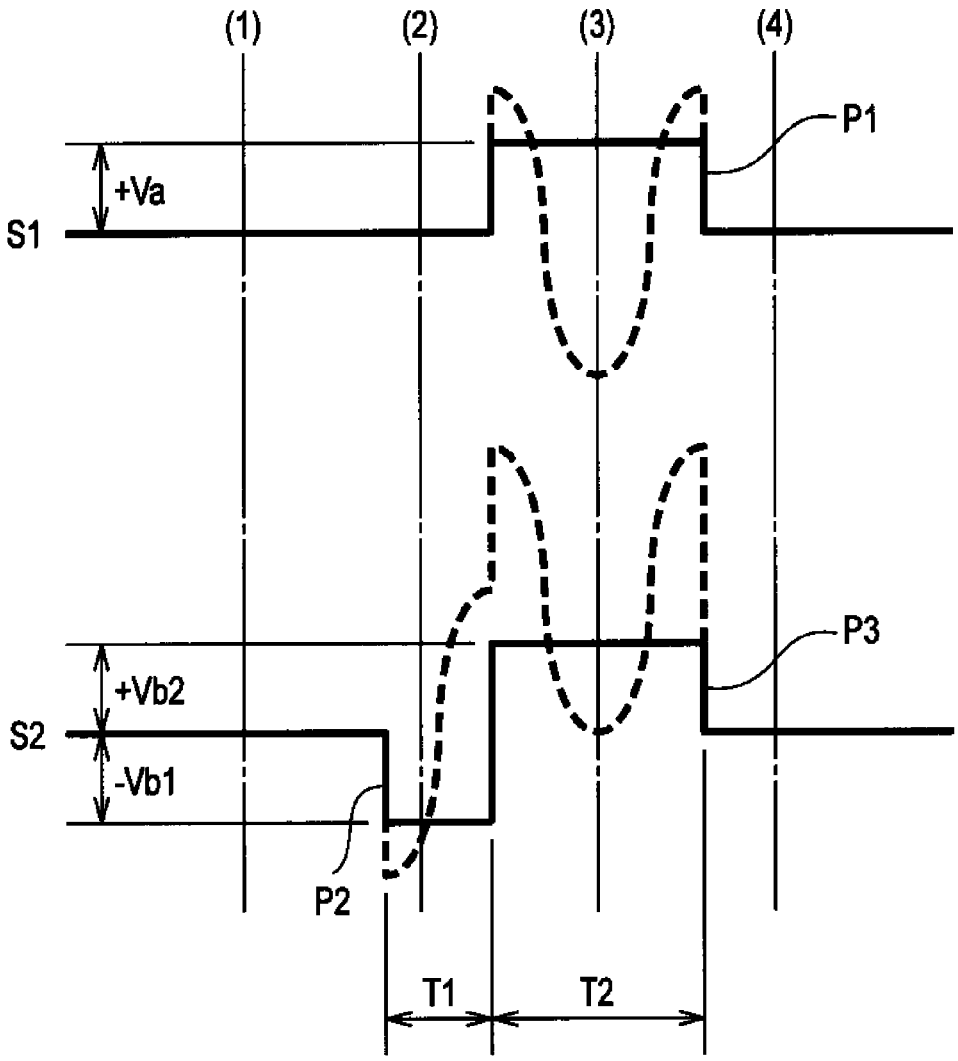
FIG. 5 is a graph showing a precursor signal and a driving signal generated from a signal generating unit.

FIG. 5 is a graph schematically showing a precursor signal S1 and a driving signal S2, each generated from the signal generating unit 44. FIG. 5 also schematically shows, by using broken lines, a pressure change of ink in the driving channels 23 by the precursor signal S1 and the driving signal S2. The pressure of the ink in the driving channels 23 varies in accordance with damping or ejection of ink drops as well as by the precursor signal S1 and the driving signal S2.

In FIG. 5, the vertical axis represents voltage, while the horizontal axis represents time. The signal generating unit 44 allows a part of the ink contained in the driving channels 23 to be ejected from the nozzles 41 as ink drops due to changes of the capacities of the driving channels 23 caused by the driving signal S2 generated from the signal generating unit 44. Ejection of ink is also caused by fine oscillation of the ink in the driving channels 23 by the precursor signal S1 generated from the signal generating unit 44.

The details of the precursor signal S1 are now explained. The signal generating unit 44 applies the precursor signal S1 to the second electrodes 32 via the second common wire 47. The signal generating unit 44 typically generates the precursor signal S1 at regular intervals regardless of the operation condition of the ink jet recording apparatus 1, i.e., whether the apparatus 1 is in a standby state or printing. However, the signal generating unit 44 may stop the output of the precursor signal S1.

The precursor signal S1 includes a precursor compression pulse P1. The precursor compression pulse P1 is a rectangular pulse having a voltage +Va and a pulse width (ON time) T2. The pulse width T2 of the precursor compression pulse P1 is equivalent to the natural oscillation period of the ink stored in the driving channels 23.

Points of time (1) through (4) are shown by one-dot chain lines in FIG. 5. During the points of time (1) and (2) before generation of the precursor compression pulse P1 from the signal generating unit 44, the first and second side walls 27 and 28 are not deformed, as illustrated in FIG. 2.

Figure 6:
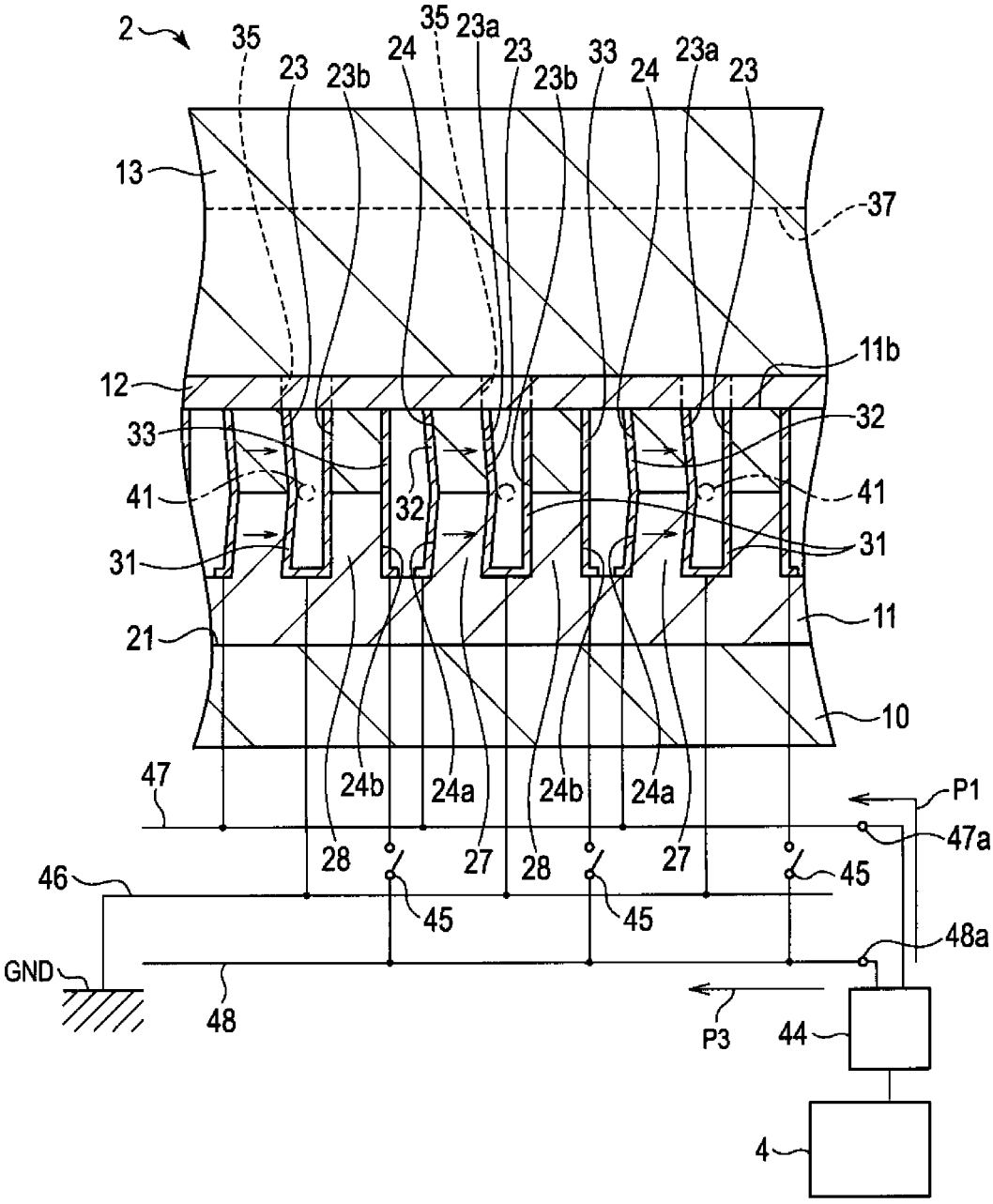
FIG. 6 is a cross-sectional view illustrating a condition of the ink jet head in which a precursor compression pulse is applied to second electrodes.

FIG. 6 is a cross-sectional view illustrating the ink jet head 2 when the precursor compression pulse P1 is applied to the second electrodes 32 after point of time (2). When the precursor compression pulse P1 is applied to the second electrodes 32, the first side walls 27 are deformed. In other words, the precursor compression pulse P1 deforms the first side walls 27.

More specifically, a potential difference is produced between the second electrodes 32 and the grounded first electrodes 31 when the precursor compression pulse P1 is applied to the second electrodes 32. This potential difference generates electric fields in the first side walls 27 in the direction perpendicular to the polarization direction. As a result, the piezoelectric bodies forming the first side walls 27 make shear deformation as indicated by arrows in FIG. 6.

The voltage +Va, i.e., the positive voltage applied to the second electrodes 32, produces deformation of the first side walls 27 such that the capacities of the driving channels 23 decrease. In other words, when the voltage is applied to the second electrodes 32, the first side walls 27 are deformed such that the capacities of the driving channels 23 vary. As a consequence, a positive pressure is applied to the ink stored in the driving channels 23, as indicated by the broken line in FIG. 5. This positive pressure applied to the ink oscillates the meniscus formed in each of the nozzles 41. However, the ink is not ejected through the nozzles 41 but instead remains within the nozzles 41. In this manner, the precursor signal S1 deforms the first side walls 27 such that the ink, including the meniscus, in each of the driving channels 23 oscillates.

When the precursor compression pulse P1 ends after the point of time (3), the shapes of the first side walls 27 return to the original shapes. As a result, the capacities of the driving channels 23 return to the original capacities, and a negative pressure is applied to the ink in the driving channels 23.

The pulse width T2 is equivalent to the natural oscillation period of the ink stored in the driving channels 23. Thus, a positive pressure is applied to the ink in the driving channels 23 when the first side walls 27 return to the original shapes. A negative pressure is then applied to the ink in the driving channels 23, as explained above, when the first side walls 27 come into the original shapes. Accordingly, the pressure oscillation generated in the ink in the driving channels 23 is cancelled with the pressure oscillation generated when the first side walls 27 return to the original shapes, and the pressure of the ink in the driving channels 23 returns to the normal pressure.

The details of the driving signal S2 are now explained. The signal generating unit 44 generates the driving signal S2 and sends the driving signal S2 to the third electrodes 33 via the third common wire 48. The signal generating unit 44 typically generates the driving signal S2 at regular intervals while the ink jet recording apparatus 1 is performing printing. However, the signal generating unit 44 may temporarily stop the output of the driving signal S2.

As shown in FIG. 5, the driving signal S2 includes a driving expansion pulse P2 and a driving compression pulse P3. The driving expansion pulse P2 is a rectangular pulse having a voltage −Vb1 and a pulse width T1. The driving compression pulse P3 is a rectangular pulse having a voltage +Vb2 and a pulse width T2. The pulse width T1 of the driving expansion pulse P2 is equivalent to the half of the natural oscillation period of the ink stored in the driving channels 23. The pulse width T2 of the driving compression pulse P3 is equivalent to the pulse width T2 of the precursor compression pulse P1. In other words, the pulse width of the driving expansion pulse P2 is equivalent to the natural oscillation period of the ink stored in the driving channels 23.

Before the point of time (1), i.e., before generation of the driving expansion pulse P2 from the signal generating unit 44, the first and second side walls 27 and 28 are not deformed, as illustrated in FIG. 2.

Figure 7:
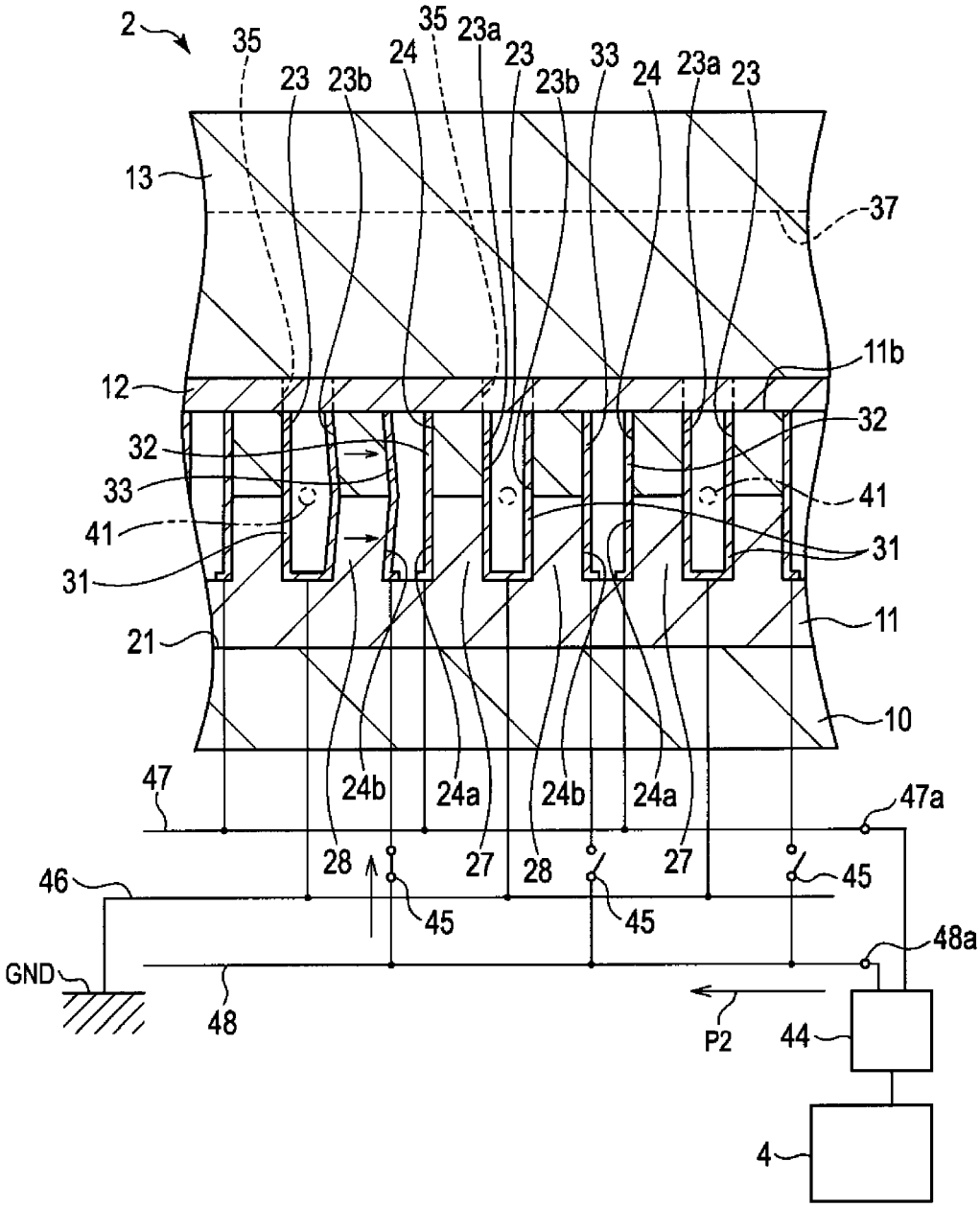
FIG. 7 is a cross-sectional view illustrating a condition of the inkjet head in which a driving expansion pulse is applied to a third electrode.
Figure 8:
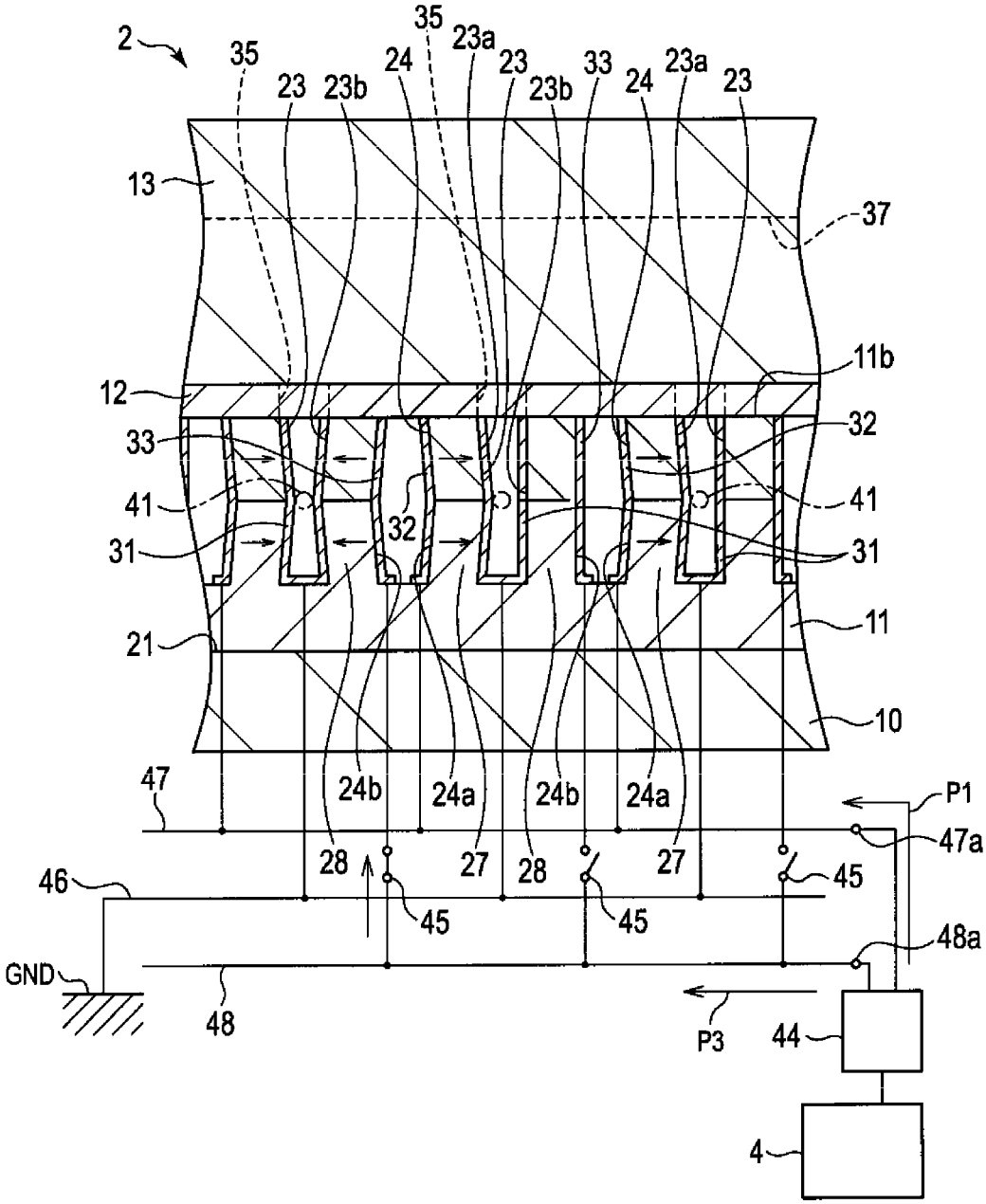
FIG. 8 is a cross-sectional view illustrating a condition of the ink jet head in which a driving compression pulse is applied to the third electrode.

FIG. 7 is a cross-sectional view illustrating the ink jet head 2 when the driving expansion pulse P2 is applied to the third electrodes 33. FIG. 8 is a cross-sectional view illustrating the ink jet head 2 when the driving compression pulse P3 is applied to the third electrodes 33.

As illustrated in FIG. 7, the control unit 4 turns on the switch 45 which corresponds to the driving channel 23 from which ink drops are ejected at an appropriate timing determined beforehand. According to the example shown in FIG. 7, the leftmost switch 45 is turned on. As a result, the signal generating unit 44 is electrically connected with the third electrode 33 connected with the turned-on switch 45.

After point of time (1), the signal generating unit 44 generates the driving expansion pulse P2. The driving expansion pulse P2 is applied to the third electrode 33, which is connected with the turned-on switch 45. In other words, the ink jet recording apparatus 1 applies the driving signal S2 to a selected one of the plural third electrodes 33. When the driving expansion pulse P2 is applied to the corresponding third electrode 33, the corresponding second side wall 28 is deformed.

More specifically, a potential difference is produced between the third electrode 33 and the grounded first electrode 31 when the driving expansion pulse P2 is applied to the third electrode 33. This potential difference generates an electric field in the second side wall 28 in the direction perpendicular to the polarization direction. As a result, the piezoelectric bodies forming the second side wall 28 make shear deformation as indicated by arrows in FIG. 7.

When the voltage −Vb1 is applied to the third electrode 33, the second side wall 28 is deformed such that the capacity of the driving channel 23 increases. In other words, when the voltage is applied to the third electrode 33, the second side wall 28 is deformed such that the capacity of the driving channel 23 becomes larger. Accordingly, a negative pressure is applied to the ink stored in the driving channel 23 as indicated by the broken line in FIG. 5. This negative pressure applied to the ink withdraws the ink meniscus in the nozzle 41, and simultaneously introduces ink from the common liquid chamber 37 into the driving channel 23.

The pulse width T1 is equivalent to the half of the natural oscillation period of the ink stored in the driving channel 23. Thus, a positive pressure is applied to the ink in the driving channel 23 at the end of the pulse width T1. Following the end of the driving expansion pulse P2, the signal generating unit 44 generates the driving compression pulse P3. The driving compression pulse P3 is also applied to the third electrode 33 connected with the turned-on switch 45.

When the driving compression pulse P3 is applied to the third electrode 33, the second side wall 28 on which the corresponding third electrode 33 is provided is deformed as illustrated in FIG. 8. In other words, the driving compression pulse P3 deforms the second side wall 28.

More specifically, a potential difference is produced between the third electrode 33 and the grounded first electrode 31 by applying the driving compression pulse P3 to the third electrode 33. This potential difference generates an electric field in the second side wall 28 in the direction perpendicular to the polarization direction. As a result, the piezoelectric bodies forming the second side wall 28 make shear deformation as indicated by arrows in FIG. 8.

By applying the positive voltage +Vb2 to the third electrode 33, the second side wall 28 is deformed such that the capacity of the driving channel 23 decreases. As a consequence, a positive pressure is applied to the ink stored in the driving channel 23 as indicated by the broken line in FIG. 5. When the driving compression pulse P3 is applied, a positive pressure is applied to the ink in the driving channel 23 as noted above. Accordingly, a positive pressure is further applied to the ink.

The precursor compression pulse P1 is generated simultaneously with generation of the driving compression pulse P3. Accordingly, when the second side wall 28 is deformed, the first side wall 27 is simultaneously deformed such that the capacity of the driving channel 23 decreases as illustrated in FIG. 8. As a result, the ink in the driving channel 23 is pressurized by both the first and second side walls 27 and 28, whereby ink drops are ejected from the nozzle 41 with rapid advancement of the ink meniscus. Thus, the driving signal S2 deforms the second side wall 28 such that ink drops in the driving channel 23 are ejected from the nozzle 41. A part of the pressurized ink is discharged through the opening 35 into the common liquid chamber 37. After ejection of ink drops, ink is again supplied to the nozzle 41 by capillary attraction of the nozzle 41.

When the driving compression pulse P3 ends after the point of time (3), the shape of the second side wall 28 returns to the original shape. As a consequence, the capacity of the driving channel 23 returns to the original capacity, whereby a negative pressure is applied to the ink in the driving channel 23.

The pulse width T2 is equivalent to the natural oscillation period of the ink stored in the driving channel 23. Thus, a positive pressure is applied to the ink in the driving channel 23 when the shape of the second side wall 28 returns to the original shape. When the shape of the second side wall 28 returns to the original shape, a negative pressure is applied to the ink in the driving channel 23 as discussed above. Accordingly, the pressure oscillation generated in the ink in the driving channel 23 is cancelled with the pressure oscillation generated when the second side wall 28 returns to the original shape, and the pressure of the ink in the driving channel 23 returns to the normal pressure.

According to the ink jet recording apparatus 1 in this embodiment, the capacities of the driving channels 23 are varied when voltages are applied to the second and third electrodes 32 and 33 formed on the dummy channels 24. As a result, the ink stored in the driving channels 23 oscillates and is ejected as ink drops through the nozzles 41. No electric fields are generated in the first electrodes 31 provided on the driving channels 23 which store ink. Accordingly, problems such as ejection failure caused by bubbles generated in the ink in the driving channels 23 due to electrolysis, and lowering of the quality of durability caused by dissolution of the first electrodes 31 are avoided even when the ink jet head 2 uses water-based ink. Accordingly, the ink jet head 2 described herein is capable of using water-based ink. Moreover, this structure eliminates the necessity of covering the first electrodes 31 with insulation film for protection, for example, and the manufacturing cost of the ink jet head 2 does not increase.

In addition, the driving channels 23 and the dummy channels 24 are alternately disposed. With this arrangement, the possibility of ejection of ink drops from the channels adjacent to the driving channels 23 is eliminated. Accordingly, the printing speed (driving frequency) increases.

The dummy channels 24 do not store ink. Rather, the dummy channels 24 hold air. This structure prevents generation of so-called cross-talk which transmits pressure from the dummy channels 24 to the driving channels 23. Furthermore, this structure avoids electrolysis caused in the dummy channels 24 when voltages are applied to the second and third electrodes 32 and 33.

The signal generating unit 44 produces the precursor signal S1 and the driving signal S2 in the same way toward the plural second and third electrodes 32 and 33. This structure eliminates the necessity of applying the precursor signal S1 and the driving signal S2 separately to the second and third electrodes 32 and 33, and heat generation and power consumption of the signal generating unit 44 decrease.

The precursor signal S1 deforms the first side walls such that the ink in the driving channels 23 oscillates. This structure stirs the ink, and avoids drying and viscosity increase of the menisci of the ink in the nozzles 41. In addition, this structure reduces coagulation and settle of ink particles.

The control unit 4 turns on and off the respective switches 45 individually as needed. Thus, deformation is made only for the second side wall 28 corresponding to the selected driving channel 23 from which ink drops are to be ejected. Accordingly, individual control for ejection of ink drops is achieved for the selected one of the plural selected nozzles 41 while reducing generation of heat or the like from the signal generating unit 44.

The pulse width T1 of the driving expansion pulse P2 is equivalent to the half of the natural oscillation period of the ink in the driving channels 23. Thus, a positive pressure is generated in the ink in the driving channels 23 at the end of the input of the driving expansion pulse P2. As a result, a high positive pressure is generated in the ink in the driving channels 23 when the driving compression pulse P3 is applied to the second electrodes 32 after the driving expansion pulse P2. Accordingly, ejection of ink drops is achieved with high efficiency.

On the other hand, the pulse width T2 of the driving compression pulse P3 is equivalent to the natural oscillation period of the ink in the driving channels 23. Thus, a positive pressure is generated in the ink in the driving channels 23 at the end of the input of the driving compression pulse P3. As a result, when a rapid deformation of the second side wall 28 is produced after the end of the input of the driving compression pulse P3, the pressure oscillation generated by the rapid deformation is cancelled with the pressure oscillation of the ink generating the positive pressure. This prevents generation of residual oscillation in the ink in the driving channels 23 caused by excessive decrease in the pressure of the ink in the driving channels 23 at the time of lowering of the pressure of the ink or for other reasons. Accordingly, the ink jet head 2 ejects ink drops in a stable condition by the reduction of residual oscillation.

The pressure oscillation of the ink in the driving channels 23 may be damped in accordance with the type, temperature, and viscosity of ink, for example. For optimizing the cancellation between the pressure oscillations in accordance with these conditions, the voltages −Vb1 and +Vb2 may be adjusted, for example. Alternatively, the voltage +Va may be adjusted while the voltages −Vb1 and +Vb2 are equalized.

The precursor compression pulse P1 is generated from the signal generating unit 44 simultaneously with generation of the driving compression pulse P3. Accordingly, the ink in the driving channels 23 is pressurized from both the first and second side walls 27 and 28, whereby ink drops are effectively ejected.

Moreover, the pulse width T2 of the precursor compression pulse P1 is equivalent to the natural oscillation period of the ink in the driving channels 23. Thus, a positive pressure is generated in the ink in the driving channels 23 at the end of the precursor compression pulse P1. As a result, when a rapid deformation of the first side walls 27 is produced after the end of the input of the precursor compression pulse P1, the pressure oscillation generated by the rapid deformation is cancelled with the pressure oscillation of the ink generating the positive pressure. This prevents generation of residual oscillation in the ink in the driving channels 23 caused by excessive decrease in the pressure of the ink in the driving channels 23 at the time of lowering of the pressure of the ink or for other reasons.

According to at least one of the ink jet recording apparatuses described herein, the capacities of the driving channels vary when voltages are applied to the second and third electrodes provided on the dummy channels. As a result, the ink stored in the driving channels oscillates, or is ejected from the nozzles corresponding to the driving channels. As a result, no voltage is applied to the first electrodes provided on the driving channels storing ink. This avoids problems such as ejection failure caused by bubbles in the ink in the driving channels by electrolysis, and lowering of the quality of durability caused by dissolution of the first electrodes even when the ink jet head uses water-based ink. Accordingly, the ink jet head provided herein becomes a type capable of using water-based ink.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, while the signal generating unit 44 is included in the driving circuit 43 of the ink jet head 2 in the described embodiment, the signal generating unit 44 may be disposed in areas other than the ink jet head 2. For example, the control unit 4 for controlling the ink jet recording apparatus 1 may function as a signal generating unit.

What is claimed is:

1. An ink jet head, comprising:

a plurality of nozzles;

a piezoelectric member having a plurality of driving channels for storing ink, each of the driving channels being in communication with a respective one of the plurality of nozzles, and a plurality of dummy channels alternately arranged with the driving channels;

a plurality of first side walls, each disposed between one of the plurality of the driving channels and one of the plurality of the dummy channels, each of the first side walls including a first driving channel side surface of the corresponding driving channel and a first dummy side surface of the corresponding dummy channel;

a plurality of second side walls, each disposed between one of the plurality of the driving channels and one of the plurality of the dummy channels, each of the second side walls including a second driving channel side surface of the corresponding driving channel opposed to the first driving channel side surface and a second dummy channel side surface of the corresponding dummy channel opposed to the first dummy channel side surface;

a plurality of first electrodes, each provided on the first and second driving channel side surfaces;

a plurality of second electrodes, each provided on the first dummy channel side surfaces, wherein when a voltage is applied to one of the second electrodes, the corresponding first side wall is deformed such that a capacity of the corresponding driving channel changes;

a plurality of third electrodes, each provided on the second dummy channel side surfaces separate from the second electrodes, wherein when a voltage is applied to one of the third electrodes, the corresponding second side wall is deformed such that the capacity of the corresponding driving channel changes;

a signal generating unit configured to generate and apply a precursor signal to the plural second electrodes which causes the first side walls to deform such that ink in the driving channels oscillates, and to generate and apply a driving signal to at least one of the plural third electrodes which causes the corresponding second side wall to deform such that ink in the driving channel is ejected from the nozzle;

a plurality of switches configured to electrically connect and disconnect the plural third electrodes to the signal generating unit; and a control unit configured to control each of the plurality of switches based on a selection of one or more of the plurality of driving channels from which ink is to be ejected.

2. The ink jet head according to claim 1, wherein the dummy channels store air and not ink.

3. The ink jet head according to claim 1, wherein the driving signal includes a driving expansion pulse causing the corresponding second side wall of the selected driving channel to deform such that the capacity of the selected driving channel increases, and a driving compression pulse generated after the driving expansion pulse causing the corresponding second side wall of the selected driving channel to deform such that the capacity of the selected driving channel decreases.

4. The ink jet head according to claim 3, wherein:

the pulse width of the driving expansion pulse is equivalent to half of a natural oscillation period of the ink in the driving channels, and the pulse width of the driving compression pulse is equivalent to the natural oscillation period of the ink in the driving channels.

5. The ink jet head according to claim 3, wherein the precursor signal includes a precursor compression pulse causing the first side walls to deform such that the capacities of the driving channels decrease, the precursor signal being generated by the signal generating unit simultaneously with generation of the driving compression pulse.

6. The ink jet head according to claim 5, wherein the pulse width of the precursor compression pulse is equivalent to the natural oscillation period of the ink in the driving channels.

7. A method of operating an ink jet head, the ink jet head including a plurality of nozzles, a piezoelectric member having a plurality of driving channels in communication with the nozzles and a plurality of dummy channels alternately arranged with the driving channels, a plurality of first side walls each disposed between one of the plurality of the driving channels and one of the plurality of the dummy channels, and a plurality of second side walls each disposed between one of the plurality of the driving channels and one of the plurality of the dummy channels, the method comprising the steps of:

grounding a plurality of first electrodes each provided on a first driving channel side surface of each of the first side walls and on a second driving channel side surface of each of the second side walls;

applying a first voltage including a precursor signal to a plurality of second electrodes each provided on a first dummy channel side surface of each of the first side walls, wherein the first voltage causes the corresponding first side wall to deform such that a capacity of the corresponding driving channel changes and the ink in the driving channel oscillates; and applying a second voltage including a driving signal to at least one of a plurality of third electrodes each provided on a second dummy channel side surface of each of the second side walls, wherein the third electrodes are separate from the second electrodes, and the second voltage causes the second side wall to deform such that the capacity of the corresponding driving channel changes and ink in the corresponding driving channel is ejected from the corresponding nozzle.

8. The method according to claim 7, wherein the driving channels store ink and the dummy channels store air and not ink.

9. The method according to claim 7, further comprising:

controlling a plurality of switches configured to electrically connect and disconnect the plural third electrodes to a signal generating unit that generates the driving signal based on a selection of one or more of the plurality of driving channels from which ink is to be ejected.

10. The method according to claim 7, wherein the driving signal includes:

a driving expansion pulse causing the corresponding second side wall of the selected driving channel to deform such that the capacity of the selected driving channel increases, and a driving compression pulse generated after the driving expansion pulse causing the corresponding second side wall of the selected driving channel to deform such that the capacity of the selected driving channel decreases.

11. The method according to claim 10, wherein:

a pulse width of the driving expansion pulse is equivalent to half of a natural oscillation period of the ink in the driving channels, and a pulse width of the driving compression pulse is equivalent to the natural oscillation period of the ink in the driving channels.

12. The method according to claim 10, wherein the precursor signal includes a precursor compression pulse causing the first side walls to deform such that the capacities of the driving channels decrease, the precursor signal being generated simultaneously with generation of the driving compression pulse.

13. The method according to claim 12, wherein the pulse width of the precursor compression pulse is equivalent to the natural oscillation period of the ink in the driving channels.

14. An ink jet printing apparatus, comprising:

a plurality of nozzles;

a piezoelectric member having a plurality of driving channels for storing ink, each of the driving channels being in communication with a respective one of the plurality of nozzles, and a plurality of dummy channels alternately arranged with the driving channels;

a plurality of first side walls, each disposed between one of the plurality of the driving channels and one of the plurality of the dummy channels, each of the first side walls including a first driving channel side surface of the corresponding driving channel and a first dummy side surface of the corresponding dummy channel;

a plurality of second side walls, each disposed between one of the plurality of the driving channels and one of the plurality of the dummy channels, each of the second side walls including a second driving channel side surface of the corresponding driving channel opposed to the first driving channel side surface and a second dummy channel side surface of the corresponding dummy channel opposed to the first dummy channel side surface;

a plurality of first electrodes, each provided on the first and second driving channel side surfaces;

a plurality of second electrodes, each provided on the first dummy channel side surfaces;

a plurality of third electrodes, each provided on the second dummy channel side surfaces separate from the second electrodes; and a signal generating unit configured to generate and apply a precursor signal to the plural second electrodes which causes the corresponding first side walls to deform such that ink in the driving channels oscillates, and to generate and apply a driving signal to at least one of the plural third electrodes which causes the corresponding second side walls to deform such that ink in the driving channels is ejected from the nozzles, wherein the precursor signal is generated and applied to the plural second electrodes at regular intervals when the apparatus is in a standby state and when the apparatus is in a printing state.

15. The ink jet printing apparatus according to claim 14, wherein the driving signal includes a driving expansion pulse causing the corresponding second side wall of the selected driving channel to deform such that the capacity of the selected driving channel increases, and a driving compression pulse generated after the driving expansion pulse causing the corresponding second side wall of the selected driving channel to deform such that the capacity of the selected driving channel decreases.

16. The ink jet printing apparatus according to claim 15, wherein:

the pulse width of the driving expansion pulse is equivalent to half of a natural oscillation period of the ink in the driving channels, and the pulse width of the driving compression pulse is equivalent to the natural oscillation period of the ink in the driving channels.

17. The ink jet printing apparatus according to claim 15, wherein the precursor signal includes a precursor compression pulse causing the first side walls to deform such that the capacities of the driving channels decrease, the precursor signal being generated by the signal generating unit simultaneously with generation of the driving compression pulse.

18. The ink jet printing apparatus according to claim 17, wherein the pulse width of the precursor compression pulse is equivalent to the natural oscillation period of the ink in the driving channels.

* * * * *